United States Patent [19]

Schär

[11] 4,039,092

[45] Aug. 2, 1977

[54] BOBBIN PACKAGE STORAGE BOX

[75] Inventor: Hugo Schär, Dattlikon, Switzerland

[73] Assignee: Rieter Machine Works, Ltd., Winterthur, Switzerland

[21] Appl. No.: 674,656

[22] Filed: Apr. 7, 1976

[30] Foreign Application Priority Data

Apr. 16, 1975 Switzerland ..... 4828/75

[51] Int. Cl.[2] ..... D01H 13/26; B60P 1/38

[52] U.S. Cl. ..... 214/83.36; 198/345; 214/38 B; 242/35.5 A

[58] Field of Search ..... 214/83.36, 16.4 R, 16.6; 198/345, 482, 484, 651; 242/35.5 A; 57/53

[56] References Cited

U.S. PATENT DOCUMENTS 2,422,768 6/1947 Benn ..... 214/83.36

3,788,054 1/1974 Haussman et al. ..... 198/651 X

*Primary Examiner*—Robert G. Sheridan

*Attorney, Agent, or Firm*—Werner W. Kleeman

[57] ABSTRACT

A bobbin package storage box which is movable on at least one rail and provided with an endless chain revolving in a substantially vertical plane. A bobbin transfer point associated with a winding machine is located at a region along the path of travel of the chain. Bolts or pins provided on the chain support full textile bobbin packages. The chain extends substantially parallel to the longitudinal direction or the direction of movement respectively, of the storage box, and the position of the bolts at the bobbin transfer point is variable while the bolts in an idling position are maintained in a predetermined position.

10 Claims, 8 Drawing Figures

BOBBIN PACKAGE STORAGE BOX

BACKGROUND OF THE INVENTION

The present invention relates to a new and improved bobbin package storage box which is movable on at least one rail and provided with an endless chain revolving in an essentially vertical plane, the chain having an upper run and a lower run provided wih pins or bolts foer supporting full textile bobbin packages.

There are already known to the art endless movable chains for taking-up or supporting bobbin packages wherein the individual chain link pins or bolts are each constructed as a hollow body in such a manner that, while the chain is at standstill, a piston provided with a gripper extends through this hollow body for taking-up a full bobbin package located on a bobbin chuck of a winding machine during a first stroke of the piston and for donning an empty bobbin tube onto the same bobbin chuck during a second stroke of the piston. The individual chain link pin or bolt in turn is provided with a centering device for supporting the bobbin tube. The chain is arranged in a horizontal plane in such a manner that the chain link bolts support the bobbin tubes in vertical direction, which necessitates that the bobbin chuck must be brought into a vertical position before the bobbins can be transferred. Hence, this apparatus is very complicated as concerns both its construction and operation.

A further disadvantage resides in the fact that since the chain supports the bobbin tubes vertically it only can be moved in a horizontal plane.

Furthermore, this type of chain is awkward and expensive due to the large dimensions of the chain link bolts necessitated by the function.

On the other hand, there are known to the art endless chains revolving in a vertical plane for transporting and for transferring bobbins wherein the chain link pins or bolts for transferring a full bobbin to a chuck of a winding machine are arranged axially and horizontally movable. The transfer of the bobbin to the chain in this arrangement is effected in one of the runs of the chain which cannot be moved in the vertical plane.

A substantial disadvantage thus resides in that there is not possible an exact positioning of the bobbin transfer location with respect to the chuck of the winding machine, unless the whole carriage can be adapted to the appropriate elevational position.

A further disadvantage is that the bolt or chain link pin is designed only for doffing a bobbin but not for donning a bobbin.

SUMMARY OF THE INVENTION

Hence, it is a primary object of the present invention to eliminate the above-mentioned disadvantages and to devise a movable bobbin package storage box for taking-up full bobbin packages doffed from a bobbin chuck at a bobbin transfer point and for jointly giving off the bobbin packages at a predetermined position.

Another object of the invention is to render the bobbin transfer point adaptable in a simple manner to the bobbin chuck position without changing the position of the bobbins in their doffing transfer position.

Now in order to implement these objects and others which will be more readily apparent as the description proceeds, there is contemplated a bobbin storage box which is movable on at least one rail and which is provided with an endless chain revolving in a vertical plane, the chain having an upper run and a lower run. There is provided a bobbin transfer point or location corresponding to or associated with a winding machine and bolts are provided on the chain for taking-up or receiving and supporting full textile bobbin packages. The chain extends substantially parallel to the longitudinal direction or to the direction of movement respectively, of the bobbin storage box, and the position of the bolts at the bobbin transfer point is adaptable or variable while the bolts in an idling or rest position are maintained in a predetermined position.

With the inventive arrangement the bobbin transfer point of the chain can be arranged in a loop of the chain which is shiftable in the vertical plane.

It also is possible that the loop can be displaceably arranged by means of a movable chain tensioning element and/or by a movable deflecting element which guides the chain.

Furthermore, there is the possibility of arranging at least two superimposed chains and that both chains can be jointly or commonly driven in such a manner that the bolts of the upper chain and the lower chain in the starting position or idling position of the chains are evenly arranged one above the other.

BRIEF DESCRIPTION OF THE DRAWINGS

The invention will be better understood and objects other that those set forth above, will become apparent when consideration is given to the following detailed description thereof. Such description makes reference to the annexed drawings wherein.

DETAILED DESCRIPTION OF THE INVENTION

Figure 2:
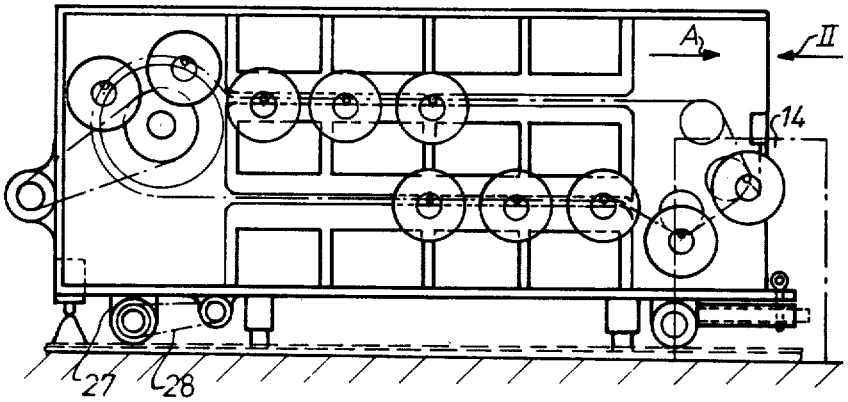
FIG. 2 illustrates the bobbin storage box according to FIG. 1 wherein however the chain is shown in its operating position, the last full bobbin package being taken up from the winding machine which has been indicated schematically with dash-dotted or phantom lines.
Figure 5:
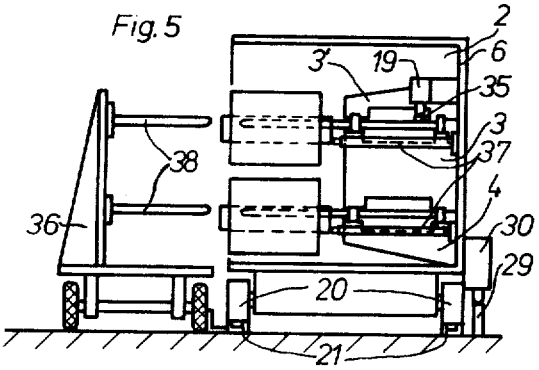
FIG. 5 is a lateral view of the bobbin storage box with a bobbin carriage shown semi-schematically and looking in the direction of the arrow I of FIG. 1.

Referring now to the drawings, a bobbin storage box 1 is formed by a frame 2 with supporting and guide elements 3, 4 and 3' respectively for taking up and guiding a conventional movable endless chain 5. The supporting elements are associated with rear or back wall 6 (FIG. 5) which is part of the frame 2 in such a manner that the endless chain 5 is movable in the direction A (FIG. 2) parallel to the rear wall 6, and thus, parallel to the longitudinal direction of the bobbin storage box.

Upon the chain 5 there are arranged supporting bolts 7 which extend substantially horizontally and perpendicular with respect to the longitudinal direction of the chain.

At one end of the bobbin storage box 1, as seen in longitudinal direction, the chain 5 is deflected and returned by a wheel 8 which is rotatably supported in the back wall 6. The diameter of the wheel 8 corresponds to about 1 ½ time the diameter of the largest bobbing package 9 in order to avoid mutual contact of the full bobbin packages located at the region of the wheel 8. At the opposite end of the bobbin storage box 1 the chain 5 is deflected by a small deflecting roll 10, the diameter of which is independent of the bobbin package diameter, and at that location chain 5 is tensioned by an upper tension roll 11 and a lower tension roll 12. At the region of the deflection of the chain 5 about the roll 10 there is located a position referred to as the bobbin transfer point or location and at which a full bobbin package 18 is removed from a bobbin chuck 13 of a winding machine 14 (only shown partially in FIG. 6) in any suitable manner and is slid onto a bolt or pin 7 or equivalent structure arranged at this region.

Figure 3:
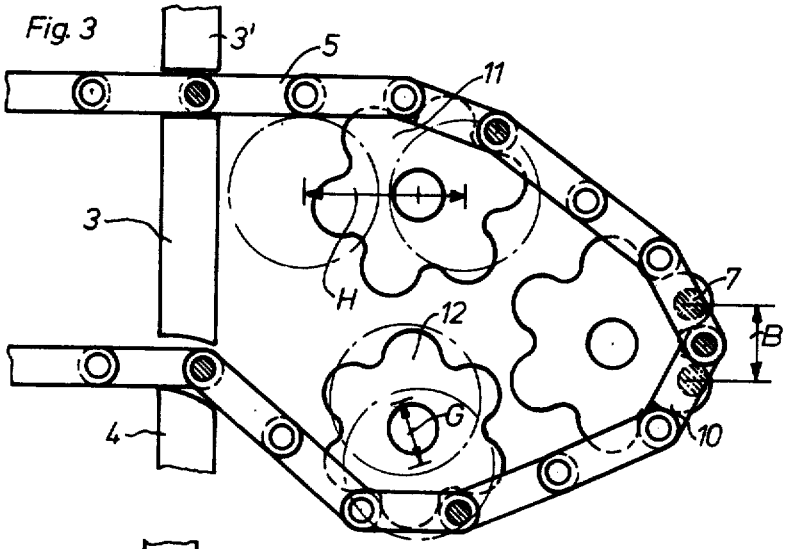
FIG. 3 is an enlarged schematic view of a return loop of the chain with a bobbin transfer point of the arrangement according to FIGS. 1 and 2.
Figure 4:
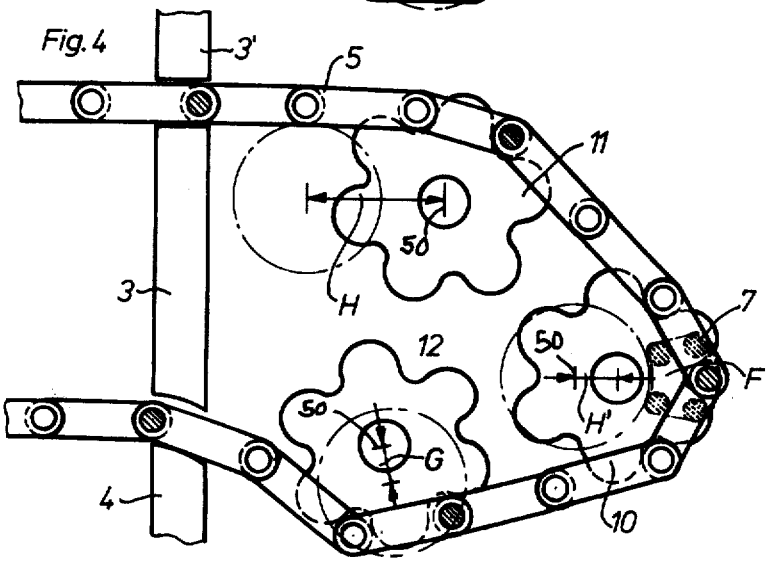
FIG. 4 is an alternative design of the elements shown in FIG. 3.

The chain 5 is tensioned by an arrangement in which the tensioning roll 11 is movable in the horizontal direction H (FIGS. 3 and 4) and the tensioning roll 12 is movable in a direction G inclined from the vertical direction away from the deflecting roll 10. Furthermore, the deflecting roll 10 also can be arranged to be movable in a horizontal direction H' (FIG. 4). The rolls 10, 11, 12 or any one of them can be appropriately shifted by any one of numerous conventional expendients, such as for instance guide tracks, guide slots, eccentric means and so forth, as generally indicated by reference character 50 in FIG. 4. In this manner the position of the bolt or pin 7 contacting the deflecting roll 10 can be changed within an area or region B (FIG. 3) along the circumference of the roll 10 or within an area or region F (FIG. 4) without longitudinally displacing the chain. The axis of the deflecting roll 10 is arranged at such an elevational position that it substantially coincides with the elevational position of the bobbin chuck 13 (FIG. 6) of the winding machine 14. The chain 5 is driven by a suitable drive motor 15 via a transmission 16 operatively connecting the motor 15 and the wheel 8. A limit switch 17 detects the position of the supporting pins 7 located at the region of the deflecting roll 10 and by means of the signal transmitted by the limit switch the drive motor 15 can be stopped. The limit switch 17 is arranged in such a manner that the supporting pin or bolt 7 located on the deflecting roll 10, when the chain 5 comes to a standstill, is disposed in the region or area B (FIG. 3) or F (FIG. 4) which corresponds to the inside diameter of the bobbin package tube 18 located on the bobbin chuck 13. The limit switch 17 is arranged to be shiftable in accordance with the shiftability of the bobbin transfer point. A further limit switch 19 is provided above the supporting pin or bolt 7 which is located in the upper run 5'' of the chain 5 in its idle position (FIGS. 1 and 5) and nearest to the deflecting roll 10 for detecting its presence.

Figure 7:
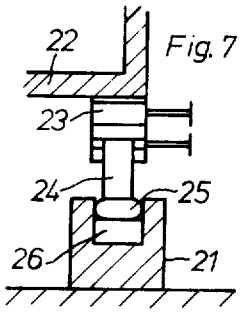
FIG. 7 schematically illustrates in enlarged view details of the bobbin storage box.

The bobbin storage box or bobbin package storage box 1 and its wheels 20 provided on the box is movable on rails 21. The wheels 20 are cylindrical and the rails 21 are provided with a horizontal rolling surface. For guiding the storage box on the rails 21 a pressure cylinder 23 is vertically arranged on a floor 22 which is part of the frame 2 above the rails 21 is such a manner that a guiding enlarged portion or head 25 (FIG. 7) provided on the piston 24 of the cylinder 23 protrudes into a guide groove 26 of the rails 21. Two cylinders 23 are provided above the same rail at a distance L which is sufficiently large for guiding the bobbin package storage box 1. For moving the bobbin storage box 1 on the rails 21 a drive motor 27 is provided at the floor 22 of the storage box which, via a transmission 28, drives at least one of the wheels 20.

Figure 1:
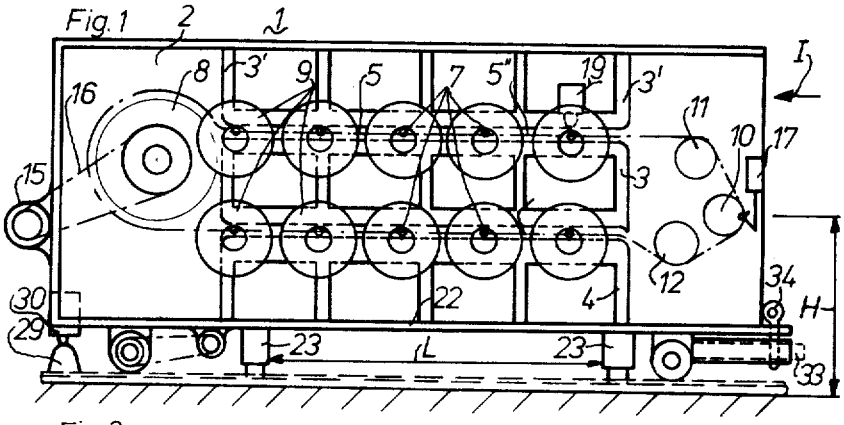
FIG. 1 is a semi-schematic longitudinal sectional view of the bobbin storage box, the chain loaded with bobbins and in an idling position after the bobbin take-up or loading operation has been completed.
Figure 6:
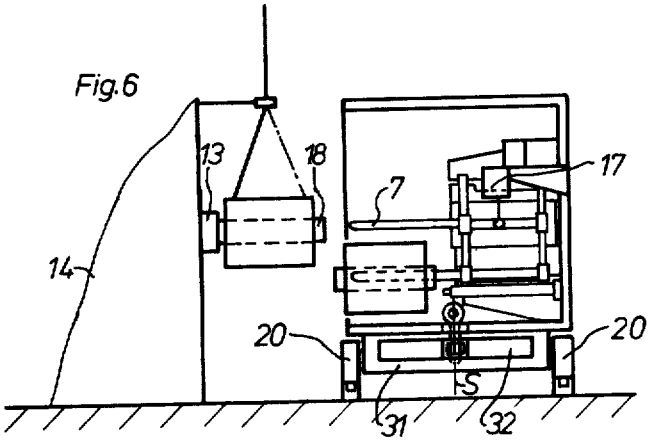
FIG. 6 is a lateral view of the bobbin storage box with a winding machine shown semi-schematically and looking in the direction of the arrow II of FIG. 2.

Switching cams 29 are provided along the rails 21 for activating a limit switch 30 arranged at the storage box-rear wall 6. The two wheels 20 at the end of the bobbin storage box 1, i.e. at the end at which there is provided the deflecting roll 10, are supported in a wheel bearing 31 which is pivotable about the axis S (FIG. 6). The wheel bearing 31 is connected with a pole support member 32 which receives a pole 33 (FIG. 1). For the positional fixation of the wheel bearing 31, a pin 34 is inserted through bores (not shown) in the floor 22 and in the pole support member 32.

In order to displace the bobbin storage box 1 on the rails 21 extending along a plurality of winding machines the drive motor 27 is activated by a suitable switch (not shown). When the limit switch 30 reaches the switching cam 29 a pulse transmitted by the limit switch 30 acts upon any suitable control device (not shown) for the immediate stoppage of the bobbin storage box 1. The switching cam 29 in this arrangement is oriented such that if the bobbin storage box 1 is at standstill and the chain 5 is brought into its working position the supporting pin or bolt (FIGS. 2 and 4) located near the limit switch 17 is placed in the area of the inside diameter of the bobbin tube 18 placed on the bobbin chuck 13.

The chain 5 is also started by a non-illustrated switch from its idle position (FIGS. 1 and 5) in which the pins or bolts are located in a predetermined arrangement as can be seen from FIG. 1, in the exemplary embodiment under discussion one vertically above the other. The chain 5 then moves in the direction of the arrow A (FIG. 2) until the first supporting pin or bolt 7 activates the limit switch 17. The pulse generated by activation of the limit switch 17, as above explained, is used in the aforementioned control device for stopping the motor 15 and the chain 5 respectively. Upon removal of the full bobbin package 18 from the bobbin chuck 13 and upon placing it onto the supporting pin or bolt 7, either manually or by any suitable transfer device, a switch is activated to again start the chain 5. The chain 5 is moved in this manner until there is placed on each supporting pin or bolt 7 a full bobbin package. After the last activation of the switch the chain 5 keeps moving until a switching cam 35 (FIG. 5) only provided on the supporting pin or bolt which was first loaded activates the limit switch 19, the signal of which, transmitted to the control device, causes the motor 15 to be stopped.

The fully loaded bobbin storage box 1 thereupon is moved to a position (FIG. 5) where the full bobbin packages 18 are transferred to a bobbin package trolley 36 (FIG. 5) or to a shipping creel (not shown). For this purpose pressure cylinders 37 are vertically mounted to the rear wall 6 in such a manner that the full bobbin packages 18 can be shifted from the supporting pins or bolts 7 onto the chucks 38 of the bobbin package trolley 36. The pressure cylinders 37 are simultaneously activated. A shipping creel can consist substantially of a standard pallet with an arrangement of chucks 38 corresponding to the ones of the bobbin package trolley 36, which shipping creel can be used as an input creel in the next operating step processing the thread wound onto the bobbin packages.

If the bobbin package storage box 1 is to be moved off the rails for inspection or for any other purpose, the bobbin package storage box 1 is moved to one end (not shown) of the rails 21 where the pin 34 is removed, the pole 33 is inserted and cylinder 23 activated in such a manner that the enlarged guide head 25 is lifted out of the guide groove 26. The bobbin package storage box 1 is subsequently steered by the pole and is drawn or pushed off the rails.

Figure 8:
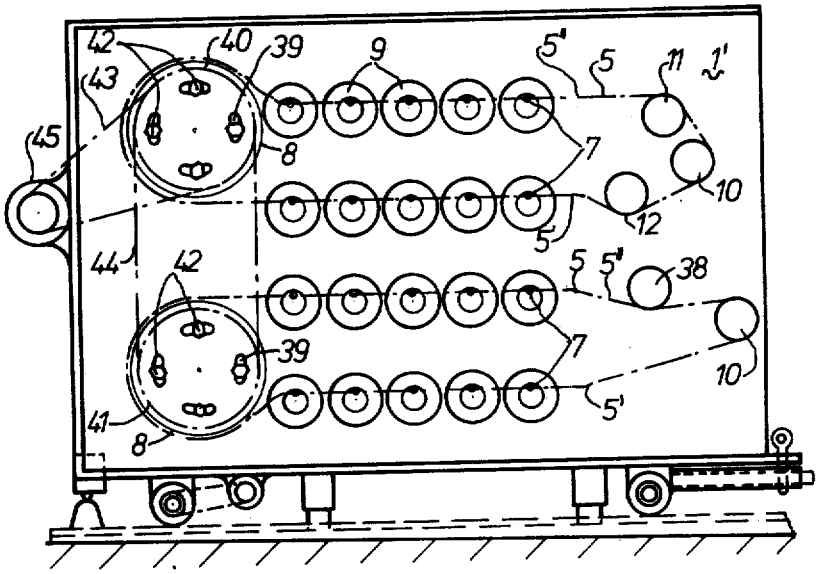
FIG. 8 is a modified embodiment of the bobbin storage box with two chains in idling position shown in longitudinal section and semi-schematically.

In FIG. 8 there is illustrated a bobbin package storage box 1' with two chains 5 arranged in superimposed fashion in such a manner that the pins or bolts 7 of both chains in the illustrated idle position of the chain 5 are located in a predetermined arrangement one vertically above the other. The vertical superimposition shown in FIGS. 1 and 8 of the bolts 7 in the superimposed runs or legs 5' and 5" of the chain is one alternative of a predetermined arrangement; in this manner the maximum number of bobbin packages per unit length of the bobbin package storage box can be stored in superimposed and adjacent relationship. The upper chain 5 corresponds to the arrangement shown and described with respect to FIGS. 3 or 4.

The lower chain, according to a modified embodiment possesses only one tensioning roll 38 which is arranged outside the deflection loop. For achieving a variable positioning of the bobbin transfer point in such modified embodiment the deflecting roll, as illustrated and described with reference to FIG. 4, is arranged to be shiftable. The adaptability of the position of the deflecting roll 10 in this arrangement is not necessarily limited to a horizontal displacement device (FIG. 4), but there is the possibility of arranging the deflecting roll to be displaceable in other directions and thereby causing a tension in the chain to be generated.

For achieving exact positioning of the pins or bolts 7 in the desired arrangement if the upper and lower chain 5 (FIG. 8) are commonly or jointly driven, the sprocket wheels or gears 8 are provided with slot or slotted openings 39 and the contacting concentric drive wheels 40 and 41 respectively (indicated with dash-dotted lines in FIG. 8) are provided with bores for fixing screws or the like (not shown). The bores for the screws are arranged within the zone of the slot openings 39 for receiving the screws 42 which penetrate through the slot openings 39 and are used for clamping together the associated sprocket wheels and the drive wheels 40 and 41. The sprocket wheel 40 carries a drive chain 43 and a transmission chain 44. The transmission chain 44 drives the drive wheel 41 while the chain sprocket 40 is driven by the drive chain 43 by means of a drive motor 45. Movement of both chains 5 and of the bobbin package storage box 1' respectively is effected in analogous manner as described for the chain 5 shown in FIGS. 1 and 2.

The lay-out and guiding of the chain is not limited to the arrangement described and illustrated. It is also possible to arrange the chain loop vertically instead or horizontally, or to provide a plurality of vertical loops in sequence in such a manner that the loading capacity is increased. Furthermore, instead of a chain also an endless tape or belt or any bendable or flexible element can be used.

Finally, there is here indicated that further advantages of the bobbin storage box reside in:

a. its compact and simple design;

b. the simple possibility of increasing the loading capacity of the bobbin package storage box over the same floor space area in vertical direction by arrangement of a second chain; and c. the bobbin package removed from the bobbin chuck are brought directly into a transporting or shipping arrangement.

While there are shown and described present preferred embodiments of the invention, it is to be distinctly understood that the invention is not limited thereto, but may be otherwise variously embodied and practiced within the scope of the following claims. Accordingly,

What is claimed is:

1. A bobbin package storage box capable of traveling upon at least one rail, comprising means defining a storage box, an endless chain provided for the storage box, means for driving the endless chain to revolve in a substantially vertical plane, a bobbin transfer point provided at a region of the path of travel of the endless chain and associated with a winding machine, bolts carried by the endless chain for receiving and supporting full textile bobbin packages, and means for selectively adjusting the position of the bolts at the bobbin transfer point according to the specific position of such bobbin transfer point while the remainder of the bolts are maintained in a predetermined position corresponding to an idling position of the endless chain.

2. The bobbin package storage box as defined in claim 1, wherein said endless chain extends substantially parallel to the longitudinal direction of the storage box.

3. The bobbin package storage box as defined in claim 1, wherein the endless chain extends substantially parallel to the direction of movement of the storage box.

4. The bobbin package storage box as defined in claim 1, wherein the endless chain has an upper run and a lower run, the bobbin transfer point of the endless chain being arranged in a loop of said endless chain which can be shifted in a vertical plane.

5. The bobbin package storage box as defined in claim 4, wherein said means for selectively adjusting the position of the bolts at the bobbin transfer point includes at least one displaceable chain tensioning element for shifting said chain loop.

6. The bobbin package storage box as defined in claim 4, wherein the means for selectively adjusting the position of the bolts at the bobbin transfer point comprises at least one displaceable chain guiding element which shifts said chain loop.

7. The bobbin package storage box as defined in claim 1, including at least one further endless chain, said two endless chains being arranged in superimposed relationship with respect to one another to define an upper chain and a lower chain, bolts provided for the further endless chain, said drive means conjointly driving both of said endless chains in such a manner that the bolts of the upper chain and the lower chain are uniformly arranged in superimposed relationship while the chains are in their idling position.

8. The bobbin package storage box as defined in claim 7, wherein said drive means for driving both endless chains comprises a sprocket wheel provided with circularly distributed slot openings and a contacting coaxially arranged driving wheel having threaded bores in the zone of the slot openings, each threaded bore being capable of receiving a screw penetrating through the associated slot opening for interconnecting the sprocket wheel and driving wheel.

9. The bobbin package storage box as defined in claim 7, wherein both chains are structured such that the bobbin transfer point of each chain can be varied in a manner that the textile bobbin packages can be taken-up simultaneously.

10. A bobbin package storage box capable of traveling upon at least one rail, comprising means defining a storage box, an endless chain mounted in the storage box, means for driving the endless chain to revolve in a substantially vertical plane, a bobbin transfer point provided at a given location along the path of travel of the endless chain, means carried by the endless chain for receiving and supporting full textile bobbin packages, and means for selectively adjusting the position of the receiving means at the bobbin transfer point in dependency upon the specific position of the bobbin transfer point while other of said receiving means are essentially maintained in a predetermined position corresponding to an idling position of the endless chain and without having to longitudinally move said chain for achieving said selectively adjusted position of the receiving means at the bobbin transfer point.

* * * * *